United States Patent [19]

Manjos et al.

[11] Patent Number: 4,829,691

[45] Date of Patent: May 16, 1989

[54] CARD DISPLAY HOLDER AND PROTECTOR

[75] Inventors: Robert M. Manjos, Roslyn; Cary Trestyn, Belrose, both of N.Y.

[73] Assignee: Ultimate Plastics, Inc., Jamaica, N.Y.

[21] Appl. No.: 89,188

[22] Filed: Aug. 25, 1987

[51] Int. Cl.[4] ..... G09F 3/18

[52] U.S. Cl. ..... 40/661; 40/642; 40/152

[58] Field of Search ..... 40/10 D, 10 R, 155–157, 40/124.4, 152, 152.1, 323, 661; 220/339; 206/503, 505, 508

[56] References Cited

U.S. PATENT DOCUMENTS

| | | | |
|---|---|---|---|
| 4,127,189 | 11/1978 | Shumrak et al. | 220/339 |
| 4,275,518 | 6/1981 | Martin | 40/10 D |
| 4,322,001 | 3/1982 | Hurley | 220/339 |
| 4,407,410 | 10/1983 | Graetz et al. | 220/339 |
| 4,477,991 | 10/1984 | Drevitch et al. | 40/152 |
| 4,561,200 | 12/1985 | Hehn | 40/156 |
| 4,635,797 | 1/1987 | Bankier | 220/339 |
| 4,681,223 | 7/1987 | Roberts | 220/339 |

*Primary Examiner*—Gene Mancene

*Assistant Examiner*—Michael Lynch

*Attorney, Agent, or Firm*—Kenyon & Kenyon

[57] ABSTRACT

A display device and protector suitable for holding a card or card-like object comprising a transparent first panel and a transparent second panel connected together along a common hinge line, the first panel having a recessed portion for receiving the card to be held, the recessed portion having a bottom surface for contacting a first surface of the card, the second panel having a projecting surface for engaging a second surface of the card, the projecting surface having a height above a base surface of the second panel which is less than a depth of the recessed portion of the first panel by the approximate thickness of the card and further comprising a mating projection and recess disposed in side walls of the recessed portion of the first panel and the projecting surface of the second panel for maintaining the first and second panels in a closed position after the first and second panels are moved toward each other by folding along the common hinge line whereby the bottom surface engages the first surface of the card and the projecting surface engages the second surface of the card, thereby allowing display of the card.

7 Claims, 2 Drawing Sheets

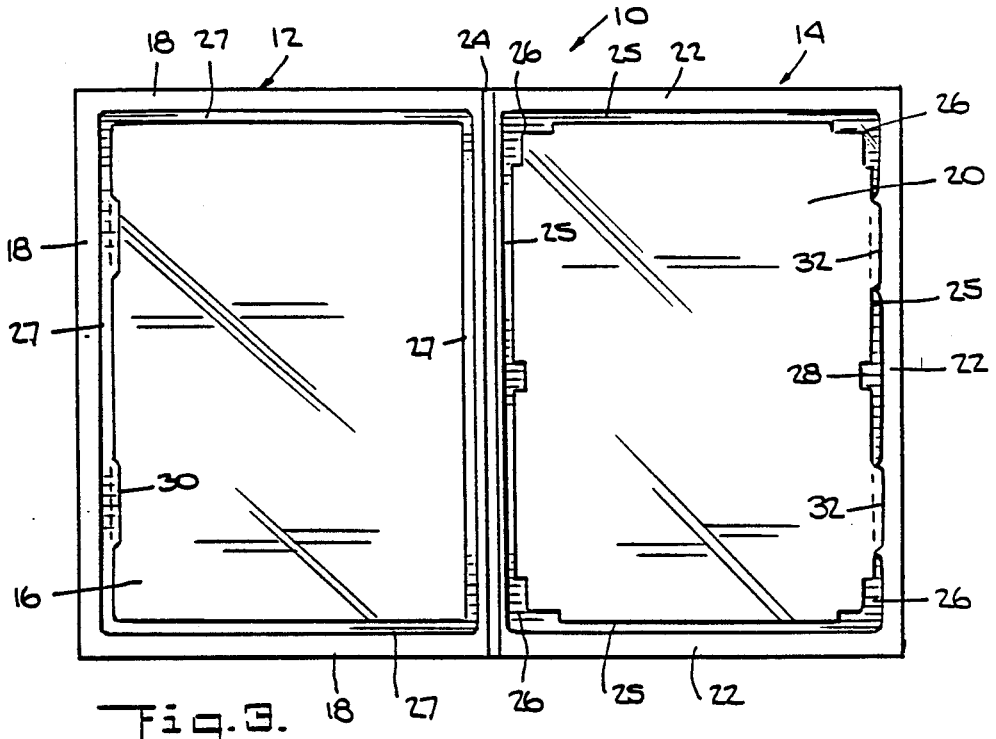
Fig. 3.
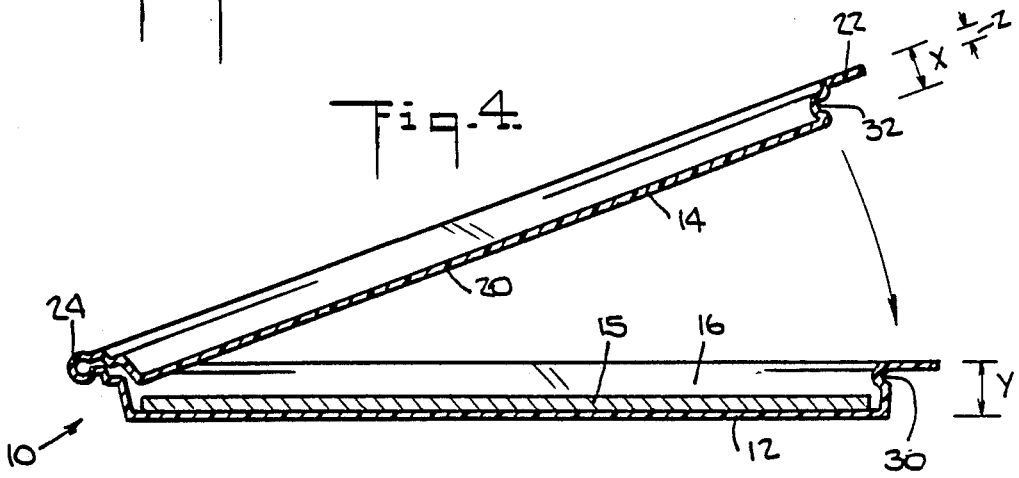
Fig. 4.
Fig. 5.
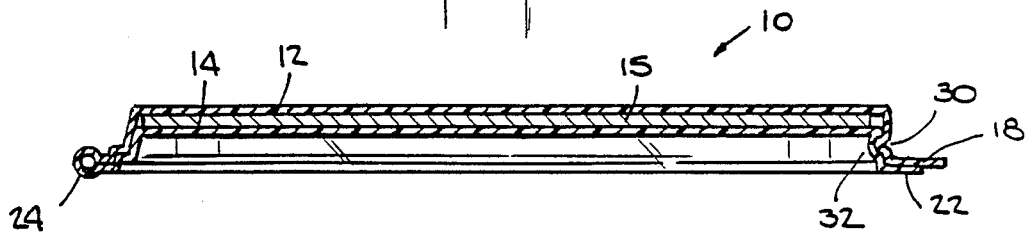

CARD DISPLAY HOLDER AND PROTECTOR

BACKGROUND OF THE INVENTION

The present invention relates to the field of image-bearing medium display devices, and in particular, to such a display device which functions as a holder/protector for an image-bearing medium, for example, a sports card, such as a baseball card.

Various display devices for displaying and protecting image-bearing media such as cards and the like are known. For example, U.S. Pat. Nos. 3,200,527, 1,932,464, 4,624,875, 2,650,444, 4,602,447 and 2,725,913 show various types of display devices.

U.S. Pat. No. 3,200,527 to Clark discloses a hinged snap-lock container for holding, for exposure or viewing, film transparencies, photographs or paintings. The container of Clark has a front and a back panel which are attached by a thin integral hinged line 15 as shown in FIG. 2 of the patent. A plurality of snap-lock portions are provided on the inside surface of the front and back panels to enable the front and back panels to be secured to each other.

U.S. Pat. No. 1,932,464 to Hyde discloses a lantern slide holder which also has a hinged line 15, but the front and back panels are secured together after folding along the hinged line by a plurality of flaps, for example, flaps 8, 9 and 10 as shown in FIG. 1 thereof. The other patents mentioned above show various other card holders and are exemplary of the prior art.

SUMMARY OF THE INVENTION

It is an object of the present invention to provide a card display holder and protector suitable for displaying, holding and protecting, for example, sports cards, such as baseball cards.

It is a further object of the present invention to provide such a card display holder and protector which protects the card, and especially its edges from damage.

It is yet another object of the present invention to provide such a card display holder and protector which is simple and inexpensive to make.

It is yet still another object of the present invention to provide such a card display holder and protector which can be conveniently stacked with other card display holders and protectors for storage.

It is yet still another object of the present invention to provide a card display holder which provides a simple means for securing a card to be protected between two transparent display panels of the holder and protector.

The above and other objects of the present invention are achieved by a display device and protector suitable for holding a card or card-like object comprising a transparent first panel and a transparent second panel connected together along a common hinge line, the first panel having a recessed portion having a depth for receiving the card to be held, the recessed portion having a bottom surface for contacting a first surface of the card, the second panel having a projecting surface having a height for engaging a second surface of the card, the height of said projecting surface above a base surface of the second panel being less than the depth of the recessed bottom surface of the first panel by the approximate thickness of the card and further comprising mating projection and recess means disposed in side walls of the recessed portion of the first panel and the projecting surface of the second panel for maintaining the first and second panels in a closed position after said first and second panels are moved toward each other by folding along said common hinge line whereby the bottom surface engages the first surface of the card and the projecting surface engages the second surface of the card, thereby allowing display of the card.

Other objects, features and advantages of the invention will be apparent from the detailed description which follows.

BRIEF DESCRIPTION OF THE DRAWINGS

The invention will be described in greater detail in the following detailed description with reference to the drawings in which:

FIG. 3 shows the card holder and protector according to the present invention in a plan view showing the holder and protector in its opened position;

FIG. 4 is a cross-sectional view of the card holder and protector according to the present invention showing how a card is inserted into the front panel of the card holder and protector and showing how the front and back display panels thereof are closed upon each other to protect the card and allow the display thereof;

FIG. 5. shows the card holder and protector according to the present invention taken along lines 5—5 of FIG. 1 and showing a card being protected between the front and back panels thereof.

DETAILED DESCRIPTION

Figure 2:
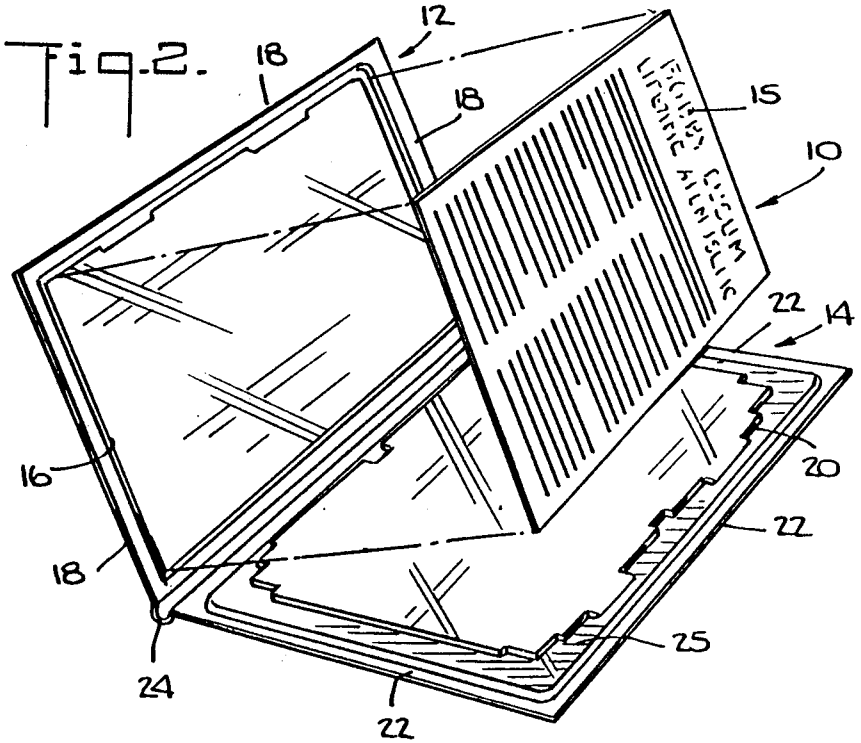
FIG. 2 shows a perspective view of the card holder and protector according to the present invention showing the card holder and protector in its opened position, and a card being placed into the front panel of the card holder and protector.

With reference now to the drawings, the card holder and protector according to the present invention is identified generally by reference numeral 10. As shown, the card holder and protector can be formed of a single piece of transparent plastic, for example, 0.015 thick polyvinyl chloride (PVC). The card holder and protector 10 comprises a front panel 12 and a rear panel 14. Front panel 12 is formed with a recess 16 into which a card 15 to be protected, as shown in FIG. 2, is inserted. Recess 16 is essentially co-extensive with the major portion of the area of the front panel, with the exception of small edge portions 18, as shown in the drawings.

The card holder and protector back panel 14 includes a projecting surface 20, which essentially is coextensive with the surface area 16 of the recess provided in the front panel. Projecting surface 20 projects from the planar base surface of the plastic sheet from which the card is made by an amount X as shown clearly in FIG. 4. The distance X is less than the distance Y by which the recessed portion of the front panel 12 is disposed below the edge portions 18 by an amount equal to the approximate thickness of the card 15. Similarly to the front panel, the back panel 14 has edge portions 22. As shown in FIG. 5, edge portion 18 may have a greater horizontal extent than edge portion 22, or vice versa in order to facilitate opening the holder when closed.

An integral hinge 24 is molded into the plastic sheet and connects the front panel 12 to the back panel 14.

Figure 6:
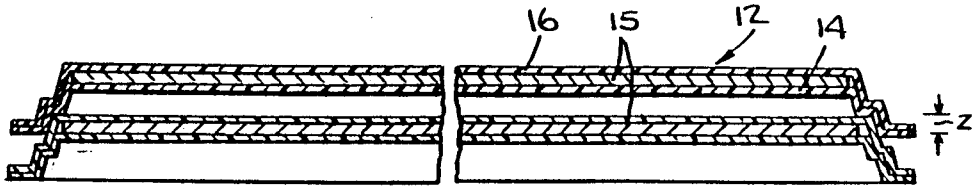
FIG. 6 shows the card holder and protector according to the present invention taken along lines 6—6 of FIG. 1 and showing a plurality of the card holders and protectors in stacked relationship.

Projecting surface 20 of the back panel 14 includes along its periphery, an intermediate surface 25 disposed at a height Z intermediate the base surface 22 and the height X of the projecting surface 20. At the four corners of the projecting surface 20, portions are provided at the height Z above the edge portions 22 extending into the projecting surface. These portions are identified by reference numerals 26 and the distance Z is shown in FIGS. 4 and 6. Furthermore, at the approximate centers of the left and rightmost edges of projecting surface 20, additional recessed areas 28 are disposed which are also located at a height Z above the surface of the edges 22 of the back panel 14. These recessed portions 26 and 28 provide a convenient means for stacking a plurality of the card holders and protectors one on top of the other as shown in FIG. 6. In order to accommodate intermediate surface 25 of back panel 14, front panel 12 also includes an intermediate surface 27 surrounding the periphery of recess 20.

In a preferred embodiment of the invention, the front panel 12 of the card holder and protector includes a pair of projections 30 facing toward the center of the card and located along the upstanding side wall of the projecting surface 16. Along the opposite edge, the upstanding side wall of projecting surface 20 of back panel 14 preferably includes a pair of recesses 32 into which the projections 30 are received when the front and rear panels are closed upon each other, as shown in FIGS. 4 and 5. The recesses 32 could alternatively be provided on front panel 12 and the projections 30 on back panel 14.

Figure 1:
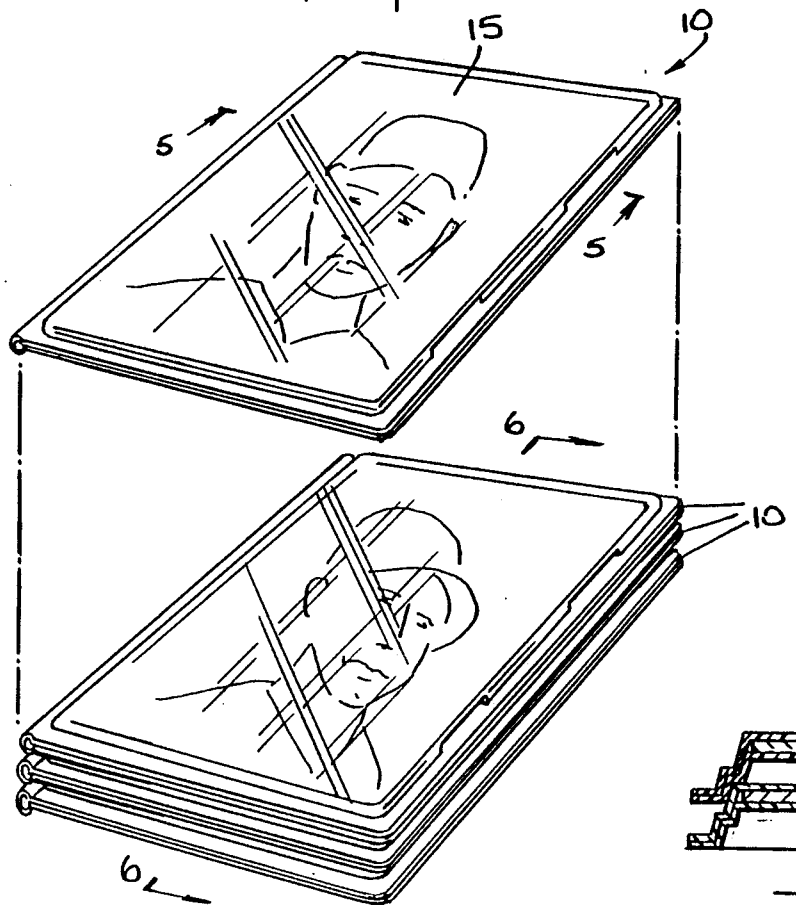
FIG. 1 shows a perspective view of a card holder and protector according to the present invention showing the card holder and protector housing a card and showing a stack of such card holders and protectors.

As shown in FIGS. 1 and 4, a preferred method of using the present invention includes the steps of placing the card to be protected face down in the recessed portion 16 of the interior of the front panel 12 of the holder and protector, and then closing the rear panel 14 on top of the card held in the front panel, thereby snapping the projections and recesses 30 and 32 together to hold the card to be protected in position. This method of using the invention is preferable because the edges and corners of the card are securely protected in the recessed area 16 of the front panel 12 and cannot be damaged by the closing of the rear panel thereon.

In the foregoing specification, the invention has been described with reference to a specific exemplary embodiment thereof. It will, however, be evident that various modifications and changes will be made thereunto without departing from the broader spirit and scope of the invention as set forth in the appended claims. The specification and drawings are accordingly to be regarded in an illustrative rather than a restrictive sense.

What is claimed is:

1. A display device and protector suitable for holding a card or card-like object comprising:

a transparent first panel and a transparent second panel connected together along a common hinge line;

said first panel having a recessed portion having a depth for receiving the card or card-like object to be held, said recessed portion having a bottom surface for contacting a first surface of the card or card-like object, said recessed portion having first side walls for abutting against respective edges of the card or card-like object;

said second panel having a projecting surface having a height for engaging a second surface of the card or card-like object, the height of said projecting surface above a base surface of said second panel being less than the depth of said recessed portion of the first panel by the approximate thickness of the card or card-like object, said projecting surface having second side walls for abutting respective ones of said first side walls of said recessed portion of the first panel, and further comprising:

portions of said projecting surface of said second panel at corners thereof which extend above said base surface by an amount less than the height of said projecting surface of said second panel, thereby allowing stacking of multiple ones of said display device and protectors;

and mating projection and recess means disposed in selected ones of said first side walls and said second side walls for maintaining said first and second panels in a closed position after said first and second panels are moved toward each other by folding along said common hinge line whereby said bottom surface engages the first surface of the card or card-like object and said projecting surface engages the second surface of the card or card-like object, thereby allowing display of said card or card-like object, said card or card-like object being securely held against movement in said recessed portion by said first side walls and said bottom and projecting surfaces.

2. The display device and protector recited in claim 1, wherein said mating projection and recess means comprises a tab projecting toward said hinge line disposed on a side wall of said recessed portion of said first panel and a recess extending toward said hinge line disposed on a side wall of said projecting surface of said second panel.

3. The display device and protector recited in claim 1, wherein said hinge line comprises a hinge integrally molded with said first and second panels.

4. The display device and protector recited in claim 1, further comprising an intermediate surface disposed about the periphery of the projecting surface extending above the base surface by the amount less than the height of the projecting surface.

5. The display device and protector recited in claim 4, further comprising an intermediate surface disposed about the periphery of said recessed portion of said first panel for accommodating said intermediate surface of said second panel when said first and second panels are closed on each other.

6. The display device and protector recited in claim 1, further comprising portions of said projecting surface of said second panel disposed adjacent approximately the center of selected ones of the side walls of said projecting surface which extend above said base surface by said amount less than the height of said projecting surface for aiding in stacking.

7. The display device and protector recited in claim 1, wherein said card or card-like object is placed into said recessed portion of said first panel with the front surface of said card or card-like object facing said bottom surface.

* * * * *